United States Patent [19]

Staab

[11] Patent Number: 4,615,783

[45] Date of Patent: Oct. 7, 1986

[54] ELECTROLYSIS CELL WITH HORIZONTALLY DISPOSED ELECTRODES

[75] Inventor: Rudolf Staab, Kelkheim, Fed. Rep. of Germany

[73] Assignee: Hoechst Aktiengesellschaft, Fed. Rep. of Germany

[21] Appl. No.: 753,915

[22] Filed: Jul. 11, 1985

[30] Foreign Application Priority Data

Jul. 13, 1984 [DE] Fed. Rep. of Germany ..... 3425862

[51] Int. Cl.[4] ..... C25B 1/46

[52] U.S. Cl. ..... 204/252; 204/251; 204/265; 204/266

[58] Field of Search ..... 204/98, 128, 251, 252, 204/263-266

[56] References Cited

U.S. PATENT DOCUMENTS

| | | | |
|---|---|---|---|
| 1,109,311 | 9/1914 | Allen | 204/251 |
| 1,187,903 | 6/1916 | Greenawalt | 204/251 |
| 3,770,611 | 11/1973 | Barnabe | 204/256 |
| 3,893,897 | 7/1975 | Raetzsch et al. | 204/98 |
| 3,901,774 | 8/1975 | Montani et al. | 204/98 |
| 3,976,550 | 8/1976 | De Nora et al. | 204/98 |
| 3,976,556 | 8/1976 | De Nora | 204/262 |
| 4,036,714 | 7/1977 | Spitzer | 204/251 |
| 4,101,407 | 7/1978 | Hilairie et al. | 204/251 |

*Primary Examiner*—John F. Niebling
*Assistant Examiner*—Terryence Chapman
*Attorney, Agent, or Firm*—Connolly and Hutz

[57] ABSTRACT

A gas-diffusion cathode is to be used in the trough-like electrolysis cell with horizontally disposed electrodes which are separated from each other by a membrane. The gas-diffusion cathode (3) rests on a grating (4) with supporting legs (2). A spacer (8) is disposed between membrane (6) and gas-diffusion cathode (3).

3 Claims, 1 Drawing Figure

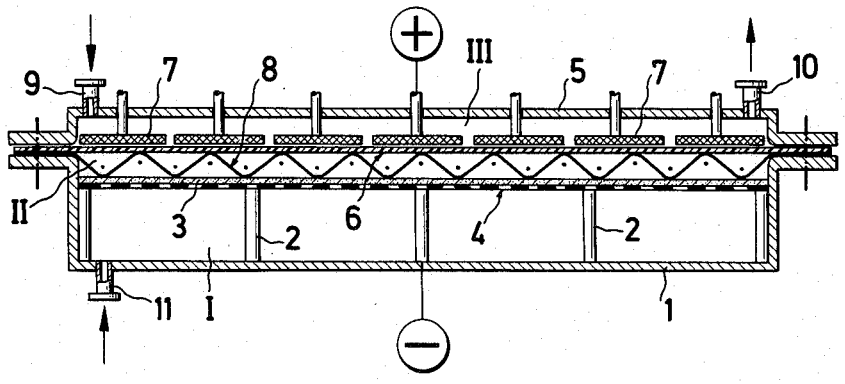
9
7
8
III
5
7
10
II
3
2
6
4
2
11
I
1

ELECTROLYSIS CELL WITH HORIZONTALLY DISPOSED ELECTRODES

BACKGROUND OF THE INVENTION

The subject of the invention is a trough-like electrolysis cell with horizontally disposed electrodes for manufacturing chlorine from alkali chloride solution by the diaphragm process, in which cell the anodes are attached to the cell cover so that their height can be adjusted.

About 50% of the world electrolysis capacity for manufacturing chlorine consists of electrolysis cells which employ the amalgamation process. The theoretical decomposition voltage for the mercury cell is approximately 3.15 to 3.20 volts. On the other hand, a theoretical decomposition voltage of approximately 2.2 volts is obtained if the alkali chloride electrolysis is carried out in a diaphragm cell with a hydrogen-producing cathode. Consequently, approximately 1 volt can theoretically be saved in cell voltage by the introduction of the diaphragm process, which is of considerable economic importance in times of rising energy costs. In addition to the energy saving, the membrane process offers the advantage of an ecologically harmless process, since no mercury is emitted, and even the lye produced is not contaminated with mercury.

The membrane cell consists of two electrolysis chambers which each have a gas-generating electrode and are separated by a cation-selective membrane. If such a membrane cell were disposed horizontally, a gas cushion consisting of chlorine or hydrogen depending on the arrangement would form underneath the membrane and the resistance of the electrolyte would cancel out the cell voltage advantage.

The object was therefore to create a membrane cell with horizontally disposed electrodes out of the mercury cell, in which membrane cell gas cushions which could affect the electrolyte resistance do not occur.

SUMMARY OF THE INVENTION

The present invention achieves the object in that a gas-diffusion cathode rests on a grating with supporting legs for supporting it on the bottom of the cell and a spacer is disposed between membrane and a gas-diffusion cathode.

The membrane may be clamped between cell cover and cell trough. The cell cover may incorporate devices for supplying and removing brine and chlorine and the cell trough devices for supplying oxygen-containing gas.

The advantage of the invention is mainly to be seen in the fact that it is possible to convert mercury cells at low cost into membrane cells with their advantages as cited above.

BRIEF DESCRIPTION OF THE DRAWING

The invention will be explained in more detail below with reference to a drawing which depicts only one method of embodiment. The FIGURE shows a cross-section through the electrolysis cell.

DETAILED DESCRIPTION OF THE INVENTION

The electrolysis cell consists of the cell trough 1 which is connected to the negative pole of the power supply. This trough is provided with supporting legs 2 which stand on the bottom of the cell and support the gas-diffusion cathode 3. At the same time they provide the current supply to the gas-diffusion cathode 3. The supporting legs 2 consist of a metallic material, preferably of the same material as the cell trough, in order to guarantee the best possible connection, eg. by welding the supporting legs, to the cell trough. The supporting legs 2 may be provided with a grating 4, on which the gas-diffusion cathode 3 rests. The gas-diffusion cathode 3 is itself a wire mesh or expanded metal coated with an electrochemically active catalyst, and is rendered water-repellent by means of a plastic, preferably polytetrafluorethylene, in order to prevent the caustic soda solution percolating through. In this way a gas space I is created, via which the gas-diffusion cathode 3 is supplied with oxygen or an oxygen-containing gas, eg. air. The gas space is provided with device or inlet 11 for feeding in oxygen or air (not shown in the FIGURE), and, if necessary, with devices for removing excess oxygen or air depleted of oxygen.

The cation-exchanging membrane 6 is clamped between the cell lid 5 and the cell trough 1. It separates the cathode space III, in which the caustic soda circulates, from the anode space III in which the conversion of the chloride ions into elemental chlorine takes place at a titanium or graphite anode 7. To ensure that the spacing between the cation-exchanging membrane and the cathode 3 is well defined and uniform, there is a spacer 8 in the cathode space II. This may take the form of a gauze consisting of a lye-resistant plastic or metal. For circulating the catholyte an inlet and outlet (not shown) provided in the cell trough 1 may be used.

The cell cover 5 is provided with a device or inlet 9 through which the anode space III can be supplied with brine. Depleted brine and the chlorine formed are removed through device or outlet 10. Graphite anodes or activated titanium anodes are used as anodes to keep the chlorine overvoltage low. The anodes 7 are attached to the cell cover in a known way so that their height can be adjusted. It is especially advantageous if the membrane 6 is in contact with the titanium anodes, and this can be achieved by means of the device for adjusting the electrode spacing.

The invention makes it possible to convert existing amalgamating plants to the membrane process using a considerable portion of the parts of the plant. If a gas-diffusion cathode is used, there is a further advantage in an additional cell voltage saving compared with membrane cells having a hydrogen-producing cathode, since the potential for oxygen reduction is approximately 1.2 volts more positive than the potential for hydrogen production.

I claim:

1. An electrolysis cell having horizontally disposed electrodes separated by a membrane and arranged to produce chlorine from an alkali chloride solution, the cell comprising a cell trough, a cell cover, a membrane between the cell trough and cover, a horizontally disposed anode attached to the cell cover and arranged for adjustable spacing relative to the membrane, a horizontally disposed gas diffusion cathode in the cell trough on the side of the membrane opposite the anode, a grating supporting the gas diffusion cathode, support legs extending between the bottom of the cell trough and the grating, and a spacer disposed between the membrane and the gas diffusion cathode.

2. An electrolysis cell as in claim 1 wherein the membrane is clamped between the cell cover and the cell trough.

3. An electrolysis cell as in claim 1 wherein the cell cover includes a device for supplying brine thereto and a device for removing brine and chlorine therefrom, and wherein the cell trough includes a device for supplying oxygen-containing gas thereto.

* * * * *